US010669132B2

(12) United States Patent
Wheeler et al.

(10) Patent No.: US 10,669,132 B2
(45) Date of Patent: Jun. 2, 2020

(54) GANTRY CRANE VEHICLES AND METHODS FOR PHOTOVOLTAIC ARRAYS

(71) Applicant: Alion Energy, Inc., Richmond, CA (US)

(72) Inventors: Timothy Wheeler, Richmond, CA (US); Brian Gray, Charlotte, NC (US)

(73) Assignee: Alion Energy, Inc., Richmond, CA (US)

( * ) Notice: Subject to any disclaimer, the term of this patent is extended or adjusted under 35 U.S.C. 154(b) by 537 days.

(21) Appl. No.: 15/140,400

(22) Filed: Apr. 27, 2016

(65) Prior Publication Data

US 2016/0311665 A1 Oct. 27, 2016

Related U.S. Application Data

(63) Continuation of application No. 13/794,217, filed on Mar. 11, 2013, now Pat. No. 9,352,941.

(Continued)

(51) Int. Cl.
*B66C 17/04* (2006.01)
*B66C 1/02* (2006.01)

(Continued)

(52) U.S. Cl.
CPC ..... *B66C 17/04* (2013.01); *B66C 1/0212* (2013.01); *B66C 1/0243* (2013.01);

(Continued)

(58) Field of Classification Search
CPC ..... B66C 17/00; B66C 17/04; B66C 17/06; B66C 19/00; B66C 19/005; B66C 1/0212; B66C 1/0262; B66C 1/0243; B66C 23/70; B66C 23/64; B66F 7/0616; E04C 2003/0426; E04C 2003/0452

(Continued)

(56) References Cited

U.S. PATENT DOCUMENTS 4,433,952 A * 2/1984 Glickman ..... B66C 19/00 180/9.46
4,676,713 A * 6/1987 Voelpel ..... B65G 49/061 414/590

(Continued)

FOREIGN PATENT DOCUMENTS

EP 1947259 A1 * 7/2008 ..... E04C 3/07

*Primary Examiner* — Michael R Mansen
*Assistant Examiner* — Juan J Campos, Jr.
(74) *Attorney, Agent, or Firm* — Jones Day

(57) ABSTRACT

Gantry crane vehicle for performing one or more tasks in a photovoltaic array and method thereof. The gantry crane vehicle includes one or more base plates, and one or more tracks above the one or more base plates. Additionally, the vehicle includes one or more gantry assemblies configured to slide along the one or more tracks, and one or more first support trusses configured to support the one or more tracks above the one or more base plates. Moreover, the vehicle includes one or more second support trusses connected to at least some of the one or more first support trusses, and one or more storage cabinets located on the one or more base plates. The one or more storage cabinets include one or more top surfaces and one or more side surfaces, and the one or more top surfaces are located below the one or more tracks.

16 Claims, 10 Drawing Sheets

Related U.S. Application Data

(60) Provisional application No. 61/613,424, filed on Mar. 20, 2012.

(51) Int. Cl.
*B66C 19/00* (2006.01)
*B66F 7/06* (2006.01)

(52) U.S. Cl.
CPC ..... *B66C 1/0262* (2013.01); *B66C 19/005* (2013.01); *B66F 7/0616* (2013.01)

(58) Field of Classification Search
USPC ..... 212/343
See application file for complete search history.

(56) References Cited

U.S. PATENT DOCUMENTS 4,706,825 A * 11/1987 Johnson ..... B66C 19/02 212/294
4,893,401 A * 1/1990 Viani ..... H01F 41/0233 29/609
5,238,716 A * 8/1993 Adachi ..... B66F 11/044 138/140
5,826,734 A * 10/1998 Baumann ..... B66C 13/54 212/291
5,893,471 A * 4/1999 Zakula ..... B66C 13/08 212/316
7,546,929 B2 * 6/2009 Wierzba ..... B66C 11/04 212/326
8,347,580 B2 * 1/2013 Beeche ..... E04C 3/06 52/204.67
2002/0053551 A1 * 5/2002 Koster ..... B66C 23/70 212/177
2007/0095776 A1 * 5/2007 Wierzba ..... B66C 13/18 212/344
2007/0095777 A1 * 5/2007 Wierzba ..... B66C 11/04 212/345
2011/0264306 A1 * 10/2011 Bagge ..... B66C 23/72 701/2
2011/0284057 A1 * 11/2011 Swahn ..... H02S 40/10 136/251
2012/0027550 A1 * 2/2012 Bellacicco ..... B60P 1/00 414/547
2012/0056638 A1 * 3/2012 Swahn ..... H02S 50/10 324/761.01

* cited by examiner

GANTRY CRANE VEHICLES AND METHODS FOR PHOTOVOLTAIC ARRAYS

1. CROSS-REFERENCES TO RELATED APPLICATIONS

This application is a continuation under 35 U.S.C. § 120 of U.S. patent application Ser. No. 13/794,217, filed Mar. 11, 2013, which claims priority to U.S. Provisional Application No. 61/613,424, filed Mar. 20, 2012, both of which are commonly assigned and incorporated by reference herein for all purposes.

2. BACKGROUND OF THE INVENTION

The present invention is directed to vehicles. More particularly, the invention provides gantry crane vehicles and methods thereof. Merely by way of example, the invention has been applied to installation and operation of photovoltaic arrays. But it would be recognized that the invention has a much broader range of applicability.

Photovoltaics convert sunlight into electricity, providing a desirable source of clean energy. FIG. 1 is a simplified diagram of a conventional photovoltaic array. The photovoltaic array 100 includes strings 1, 2, 3, 4, . . . n, where n is a positive integer larger than or equal to 1. Each string includes photovoltaic (PV) modules (e.g., solar panels) that are connected in series. The photovoltaic array 100 is connected to a central inverter 110, which provides an alternating current (AC) connection to a power grid 120. FIG. 2 is a simplified diagram of a conventional photovoltaic module. The photovoltaic (PV) module 210 includes a junction box 220 on the backside of the PV module 210.

The installation of photovoltaic arrays often presents logistical challenges. Not only does the site for the photovoltaic array need to be properly prepared, but large quantities of materials also need to be transported to and within the site. For example, the site for the photovoltaic array may have existing vegetation that would interfere with the installation and operation of the photovoltaic array. This vegetation usually has to be cleared. The site may also have uneven terrain that usually requires extensive grading and earth moving. Once the site is prepared, it is then often necessary to build an extensive infrastructure on which the strings of PV modules 210 are to be affixed. The PV modules 210 are then moved into position, affixed to the structure, and interconnected so that power can be delivered to the power grid 120. Each of these operations can be time-consuming and expensive.

Once the photovoltaic array is in operation, additional infrastructure often is used to support, maintain, evaluate, and repair the array. In order to support the operation of the photovoltaic array, equipment and materials routinely need to be transported from one end of the array to another. For example, the test equipment is transported to a PV module that is under evaluation. In another example, the cleaning equipment is transported to remove debris and dirt from the PV module. In yet another example, an additional module is transported as replacement for the defective module. Depending upon the terrain, soils, and weather, simply getting equipment and materials from one end of the array to another often poses significant challenges, especially if the ground is muddy. As with the installation, these operational needs can also be time-consuming and expensive.

Hence, it is highly desirable to improve techniques for installation and operation of photovoltaic arrays.

3. BRIEF SUMMARY OF THE INVENTION

The present invention is directed to vehicles. More particularly, the invention provides gantry crane vehicles and methods thereof. Merely by way of example, the invention has been applied to installation and operation of photovoltaic arrays. But it would be recognized that the invention has a much broader range of applicability.

According to one embodiment, a gantry crane vehicle for performing one or more tasks in a photovoltaic array includes one or more base plates, and one or more tracks above the one or more base plates. Additionally, the vehicle includes one or more gantry assemblies configured to slide along the one or more tracks, and one or more first support trusses configured to support the one or more tracks above the one or more base plates. Moreover, the vehicle includes one or more second support trusses connected to at least some of the one or more first support trusses, and one or more storage cabinets located on the one or more base plates. The one or more storage cabinets include one or more top surfaces and one or more side surfaces, and the one or more top surfaces are located below the one or more tracks. The one or more second support trusses are attached to the one or more side surfaces through one or more attachment components. Each of the one or more gantry assemblies includes a lift component and one or more frame components attached to the lift component. The lift component is configured to move the one or more frame components from a first position above one or more planes corresponding to the one or more base plates to a second position below the one or more planes corresponding the one or more base plates.

According to another embodiment, a gantry crane vehicle for performing one or more tasks in a photovoltaic array includes one or more base plates, and one or more tracks above the one or more base plates. Additionally, the vehicle includes one or more gantry assemblies configured to slide along the one or more tracks, and one or more first support trusses configured to support the one or more tracks above the one or more base plates. Moreover, the vehicle includes one or more second support trusses connected to at least some of the one or more first support trusses, and one or more storage cabinets located on the one or more base plates. The one or more storage cabinets include one or more top surfaces and one or more side surfaces, and the one or more top surfaces are located below the one or more tracks. Each of the one or more gantry assemblies includes a lift component and one or more frame components. The one or more frame components are attached to the lift component, and include a first frame component. The lift component is configured to move the one or more frame components from a first position above one or more planes corresponding to the one or more base plates to a second position below the one or more planes corresponding to the one or more base plates. The first frame component is configured to hold an object and roll the held object around an axis.

According to yet another embodiment, a gantry crane vehicle for performing one or more tasks in a photovoltaic array includes one or more base plates, and one or more tracks above the one or more base plates. Additionally, the vehicle includes one or more gantry assemblies configured to slide along the one or more tracks, and one or more first support trusses configured to support the one or more tracks above the one or more base plates. Moreover the vehicle includes one or more second support trusses connected to at least some of the one or more first support trusses, and one or more storage cabinets located on the one or more base plates. The one or more storage cabinets include one or more top surfaces and one or more side surfaces. The one or more top surfaces are located below the one or more tracks, and are separated from the one or more tracks by one or more distances respectively. The gantry crane vehicle is configured to change the one or more distances from one or more first distance magnitudes to one or more second distance magnitudes respectively, and the one or more second distance magnitudes are smaller than the one or more first distance magnitude respectively.

According to yet another embodiment, a gantry crane vehicle for performing one or more tasks in a photovoltaic array includes one or more base plates, and one or more tracks above the one or more base plates. Additionally, the vehicle includes one or more gantry assemblies configured to slide along the one or more tracks. Moreover, the vehicle includes one or more first support trusses attached to the one or more base plates and substantially perpendicular to the one or more base plates, one or more second support trusses connected to at least some of the one or more first support trusses, and one or more third support trusses each connected to at least some of the one or more first support trusses or at least some of the one or more second support trusses. Also, the vehicle includes one or more storage cabinets located on the one or more base plates. The one or more storage cabinets include one or more top surfaces and one or more side surfaces, and the one or more top surfaces are located below the one or more tracks. Each of the one or more gantry assemblies includes a lift component and one or more frame components attached to the lift component. The lift component is configured to move the one or more frame components from a first position above one or more planes corresponding to the one or more base plates to a second position below the one or more planes corresponding to the one or more base plates. Each of the one or more third support trusses includes a first side component, a second side component, and multiple middle components. Each of the multiple middle components is sandwiched between and in contact with the first side component and the second side component. The multiple middle components are separated from each other by one or more slots.

Depending upon the embodiment, one or more benefits may be achieved. These benefits and various additional objects, features, and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

The present invention is directed to vehicles. More particularly, the invention provides gantry crane vehicles and methods thereof. Merely by way of example, the invention has been applied to installation and operation of photovoltaic arrays. But it would be recognized that the invention has a much broader range of applicability.

A photovoltaic array can be organized around one or more rails. For example, at least one of the one or more rails is configured for the installation of one or more photovoltaic modules (e.g., PV modules). In another example, the one or more rails include one or more support surfaces configured to allow one or more vehicles to move about the photovoltaic array. In yet another example, the one or more vehicles perform one or more installation, operation, and/or maintenance tasks in the photovoltaic array.

Figure 1:
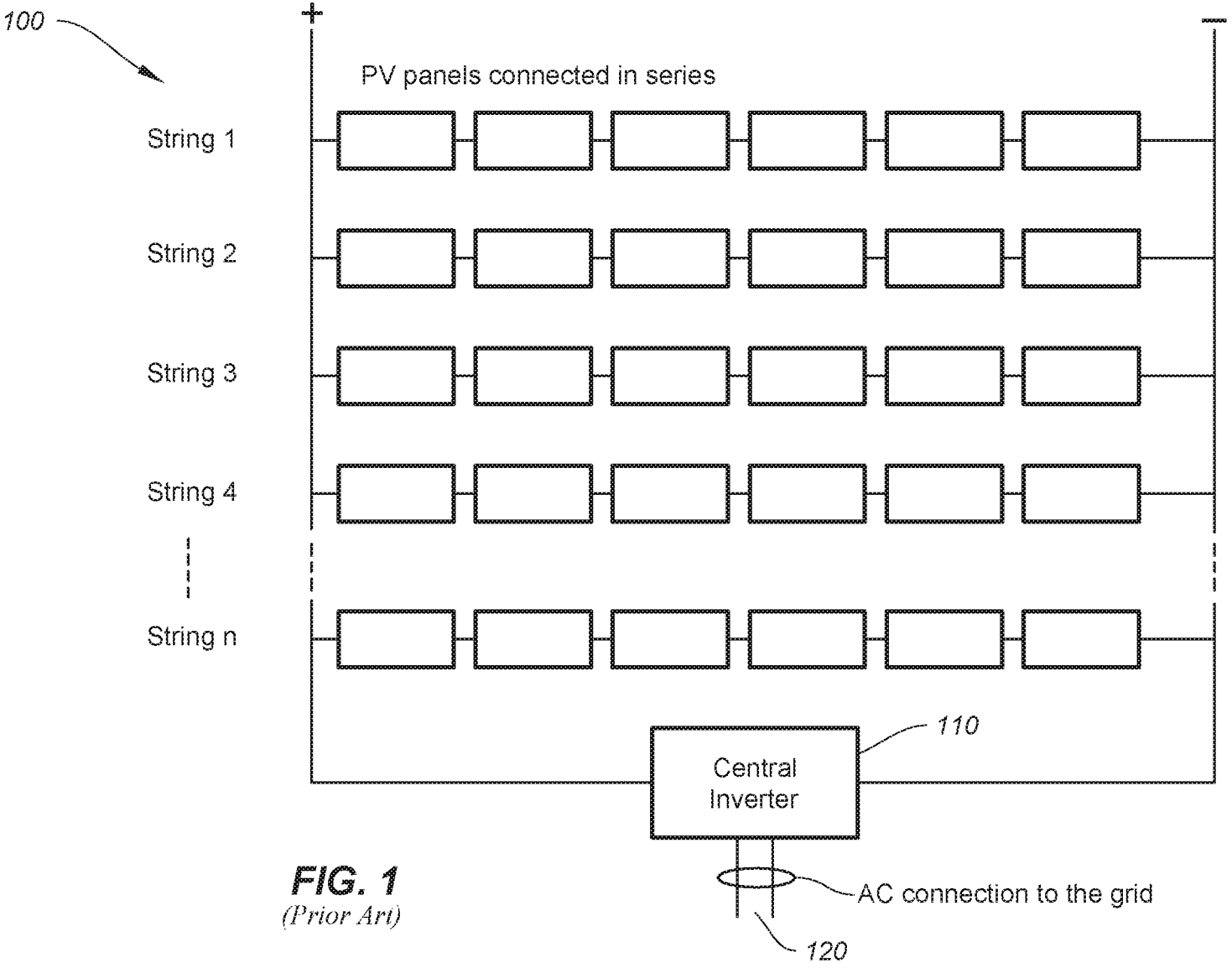
FIG. 1 (Prior Art)
FIG. 1 is a simplified diagram of a conventional photovoltaic array.
Figure 2:
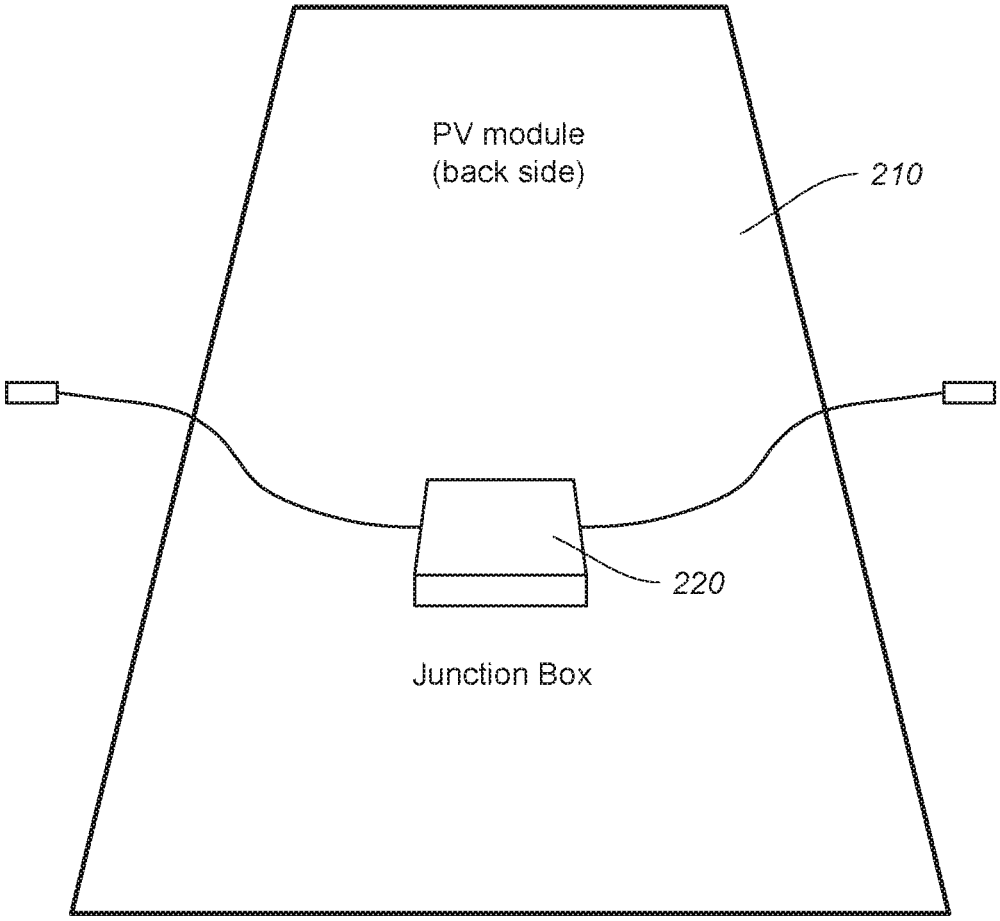
FIG. 2 (Prior Art)
FIG. 2 is a simplified diagram of a conventional photovoltaic module.
Figure 3:
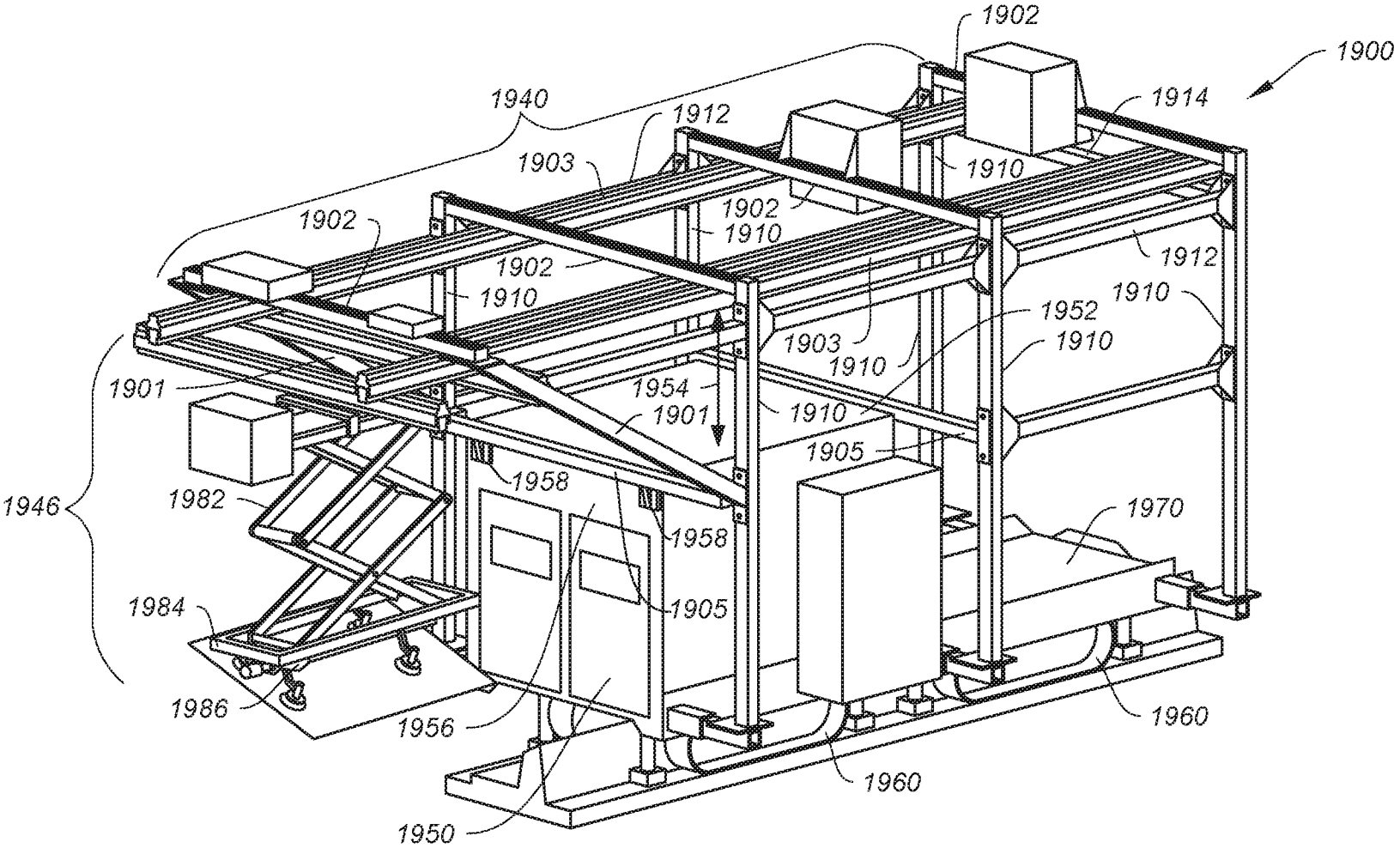
FIG. 3 is a simplified diagram of a gantry crane vehicle for performing one or more tasks in a photovoltaic array according to one embodiment of the present invention.

FIG. 3 is a simplified diagram of a gantry crane vehicle for performing one or more tasks in a photovoltaic array according to one embodiment of the present invention. This diagram is merely an example, which should not unduly limit the scope of the claims. One of ordinary skill in the art would recognize many variations, alternatives, and modifications.

As shown in FIG. 3, the vehicle 1900 includes one or more gantry systems 1940. For example, the one or more gantry systems 1940 include one or more tracks 1903, one or more gantry assemblies 1946, and/or one or more support trusses 1901, 1902, 1905, 1910, 1912, and 1914. In another example, the one or more support trusses 1901, 1902, 1905, 1910, 1912, and 1914 extend the one or more gantry systems 1940 above the vehicle 1900. In yet another example, the one or more support trusses 1901, 1902, 1905, 1910, 1912, and 1914 extend the one or more gantry systems 1940 beyond a front end of the vehicle 1900. In yet another example, the one or more support trusses 1901, 1902, 1905, 1910, 1912, and 1914 extend the one or more gantry systems 1940 beyond a rear end of the vehicle 1900. In yet another example, the one or more support trusses 1901, 1902, 1905, 1910, 1912, and 1914 extend the one or more gantry systems 1940 beyond one side or both sides of the vehicle 1900.

In yet another example, the one or more tracks 1903 extend to at least the edges of one of the one or more gantry systems 1940. In yet another example, the one or more gantry assemblies 1946 are mounted on the one or more tracks 1903 so that the one or more gantry assemblies 1946 are positionable anywhere (e.g., by sliding) along the one or more tracks 1903. In yet another example, each of the one or more gantry assemblies 1946 is equipped with at least a universal gripping attachment and/or a lifting mechanism. According to some embodiments, one or more tools are attached to the one or more gantry assemblies 1946. For example, the one or more tools are parts of the one or more gantry assemblies 1946. In another example, the one or more tools are used to perform one or more tasks needed during installation, operation, and/or maintenance of the photovoltaic array.

Also as shown in FIG. 3, the vehicle 1900 further includes one or more storage cabinets 1950, one or more continuous tracks and/or caterpillar treads 1960, and one or more base plates 1970. For example, the one or more storage cabinets 1950 are located on the one or more base plates 1970. In yet another example, the one or more continuous tracks and/or caterpillar treads 1960 are configured to roll around on one or more support surfaces and to support the one or more base plates 1970 above the one or more support surfaces.

In one embodiment, the one or more storage cabinets 1950 contain one or more power supplies and/or one or more cargo areas. In another embodiment, the one or more storage cabinets 1950 include one or more top surfaces 1952 and one or more side surfaces 1956. For example, the one or more top surfaces 1952 are located below the one or more tracks 1903 by one or more separation distances 1954 respectively. In another example, each of the one or more support trusses 1905 is connected to two support trusses 1910, and is attached to the side surface 1956 through one or more attachment components 1958.

In yet another embodiment, the one or more gantry assemblies 1946 each include a scissor lift component 1982 and frame components 1984 and 1986. For example, the frame component 1984 (e.g., a square frame) is connected to an end of the scissor lift component 1982. In another example, the frame component 1986 (e.g., an object-holding sub-frame) is mounted to the frame component 1984. In yet another example, the frame component 1986 includes one or more gripping and/or tool components.

Figure 4:
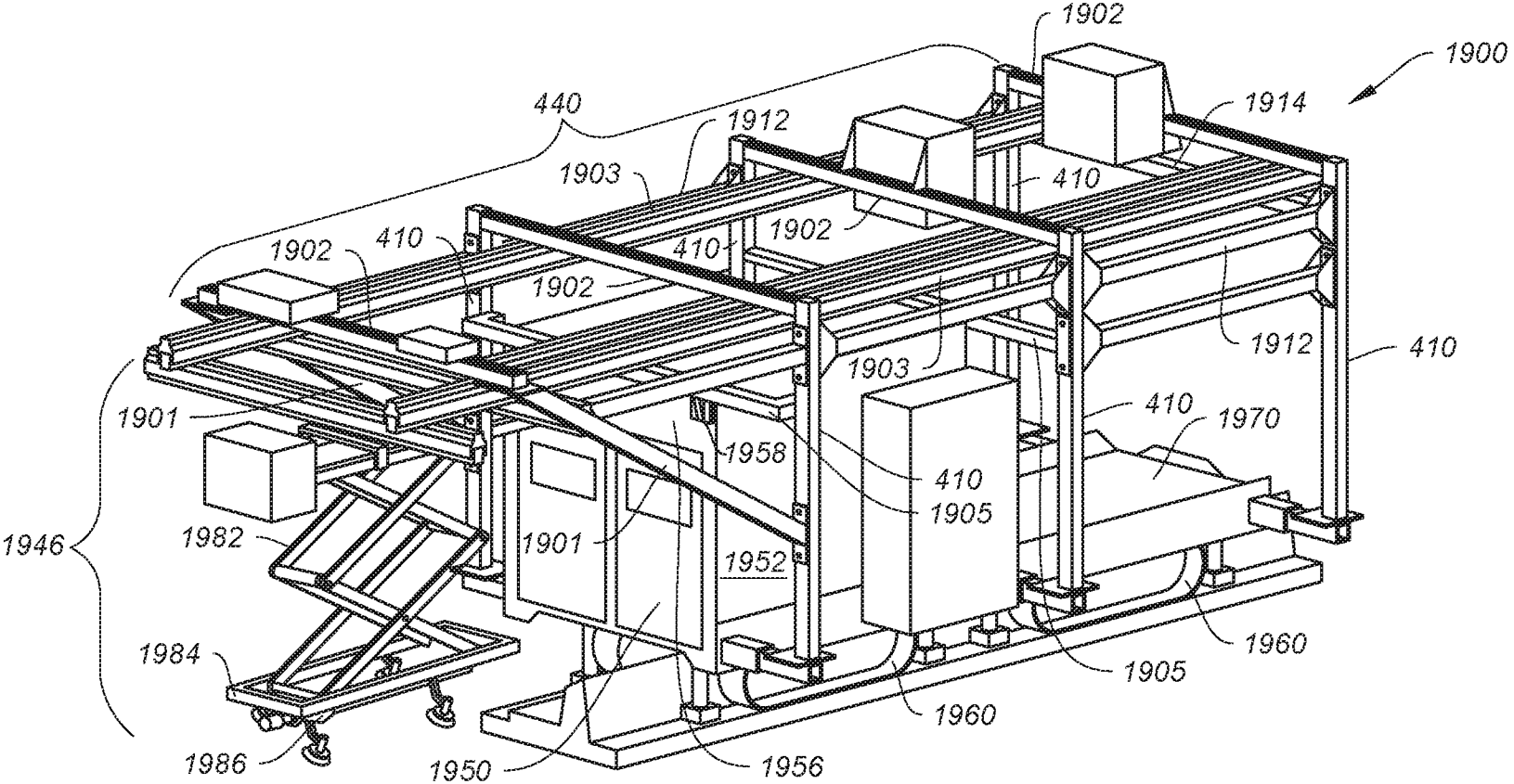
FIG. 4 is a simplified diagram of the gantry crane vehicle for storage and/or shipping according to another embodiment of the present invention.
Figure 5:
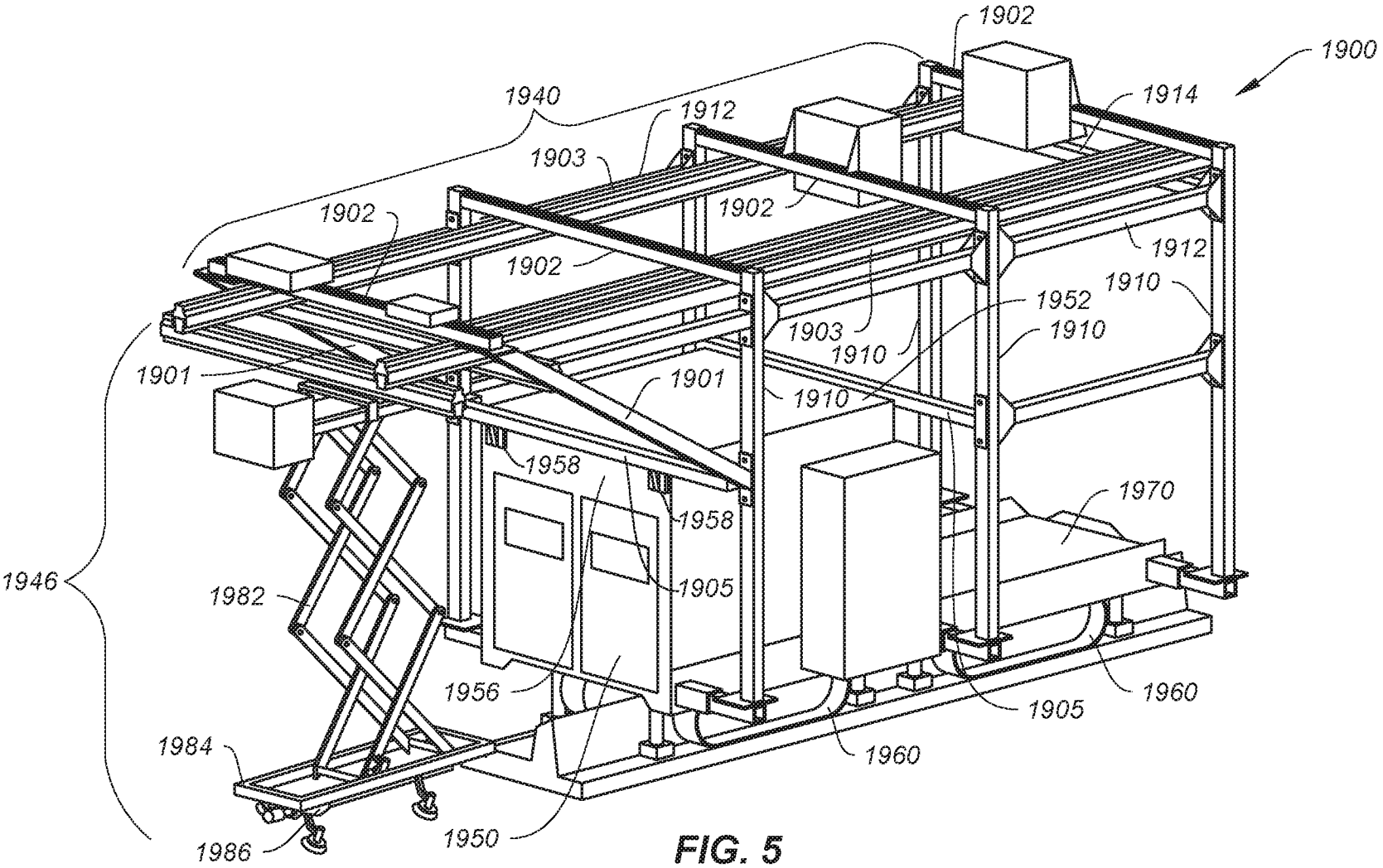
FIG. 5 is a simplified diagram of a gantry crane vehicle for performing one or more tasks in a photovoltaic array according to yet another embodiment of the present invention.

As discussed above and further emphasized here, FIG. 3 is merely an example, which should not unduly limit the scope of the claims. One of ordinary skill in the art would recognize many variations, alternatives, and modifications. For example, the vehicle 1900 is used as an installation vehicle, a supply vehicle, and/or a maintenance vehicle. In another example, the vehicle 1900 is used to partially or fully automate one or more operational tasks of the photovoltaic array, including without limitation one or more maintenance, diagnostics, material supply, and/or repair functions for the photovoltaic array. In yet another example, the vehicle 1900 is modified by replacing the one or more support trusses 1910 with one or more other trusses that are shorter than the one or more support trusses 1910 respectively, as shown in FIG. 4. In yet another example, the frame components 1984 and 1986 can be placed above the one or more corresponding planes of the one or more base plates 1970, or placed below the one or more corresponding planes of the one or more base plates 1970 as shown in FIG. 5.

FIG. 4 is a simplified diagram of the gantry crane vehicle 1900 for storage and/or shipping according to another embodiment of the present invention. This diagram is merely an example, which should not unduly limit the scope of the claims. One of ordinary skill in the art would recognize many variations, alternatives, and modifications.

According to one embodiment, the vehicle 1900 includes the one or more gantry systems 440. For example, the one or more gantry systems 440 include the one or more tracks 1903, the one or more gantry assemblies 1946, the one or more support trusses 1901, 1902, 1905, 1912, and 1914, and/or one or more support trusses 410. For example, the one or more support trusses 410 are shorter than the one or more support trusses 1910 respectively.

According to another embodiment, the vehicle 1900 further includes the one or more storage cabinets 1950, the one or more continuous tracks and/or caterpillar treads 1960, and the one or more base plates 1970. For example, the one or more storage cabinets 1950 include the one or more top surfaces 1952. In another example, the one or more top surfaces 1952 are located below the one or more tracks 1903 by one or more separation distances that are smaller than the one or more separation distances 1954 respectively. In yet another example, as shown in FIG. 4, the one or more separation distances are equal to zero or substantially equal to zero.

FIG. 5 is a simplified diagram of a gantry crane vehicle for performing one or more tasks in a photovoltaic array according to yet another embodiment of the present invention. This diagram is merely an example, which should not unduly limit the scope of the claims. One of ordinary skill in the art would recognize many variations, alternatives, and modifications.

According to one embodiment, the vehicle 1900 includes the one or more gantry systems 1940. For example, the one or more gantry systems 1940 include the one or more tracks 1903, the one or more gantry assemblies 1946, and/or the one or more support trusses 1901, 1902, 1905, 1910, 1912, and 1914. According to another embodiment, the vehicle 1900 further includes the one or more storage cabinets 1950, the one or more continuous tracks and/or caterpillar treads 1960, and the one or more base plates 1970. According to yet another embodiment, the one or more gantry assemblies 1946 each include the scissor lift component 1982 and the frame components 1984 and 1986. For example, the scissor lift component 1982 is configured to extend so that the frame components 1984 and 1986 reach below the one or more corresponding planes of the one or more base plates 1970.

Figure 6B:
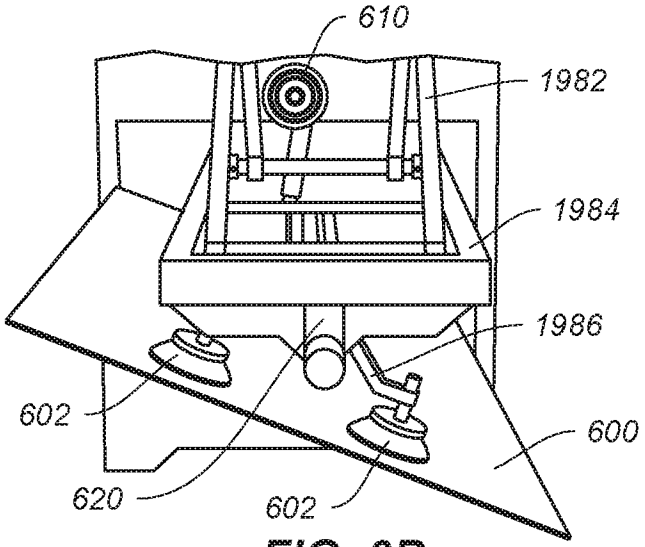
FIGS. 6A-6B are simplified diagrams of the gantry assembly as part of the gantry crane vehicle for performing one or more tasks in a photovoltaic array according to one embodiment of the present invention.
Figure 6A:
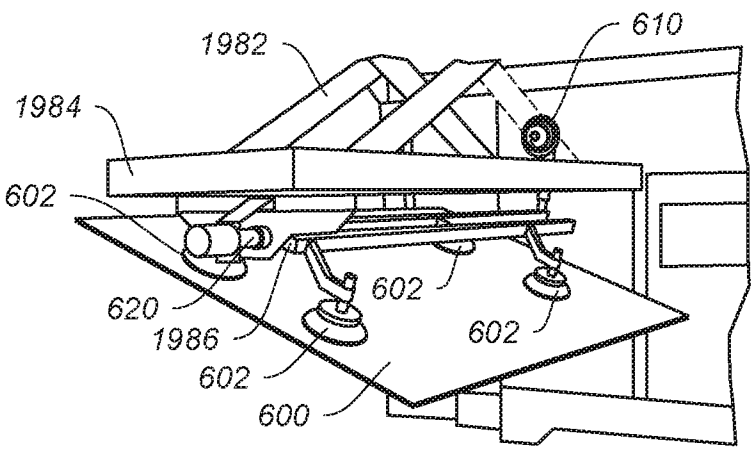

FIGS. 6A-6B are simplified diagrams of the gantry assembly 1946 as part of the gantry crane vehicle 1900 for performing one or more tasks in a photovoltaic array according to one embodiment of the present invention. These diagrams are merely examples, which should not unduly limit the scope of the claims. One of ordinary skill in the art would recognize many variations, alternatives, and modifications.

According to one embodiment, the gantry assembly 1946 includes the scissor lift component 1982 and frame components 1984 and 1986. For example, the frame component 1984 is a square frame. In another example, the frame component 1986 is an object-holding sub-frame (e.g., a panel-holding sub-frame). In yet another example, the frame component 1986 includes one or more gripping and/or tool components. In yet another example, the frame component 1986 includes multiple suction cups 602 configured to hold a panel 600 (e.g., a solar panel). In yet another example, the panel 600 held by the frame component 1986 can be rolled around an axis 620 for placement.

According to another embodiment, the gantry assembly 1946 further includes an actuator 610. For example, the actuator 610 is configured to exert a moment on the panel-holding sub-frame 1986 so that the panel 600 held by the frame component 1986 can be rolled for placement. According to yet another embodiment, the lifting mechanism on each of the one or more gantry assemblies 1946 includes a tilt axis to shift at least a tool and/or a gripping mechanism from one position to another position. For example, the lifting mechanism on each of the one or more gantry assemblies 1946 includes a tilt axis to shift at least a tool and/or a gripping mechanism from a vertical or horizontal position to a position parallel with or perpendicular to the plane of one or more photovoltaic modules (e.g., PV modules) in the photovoltaic array.

Figure 7B:
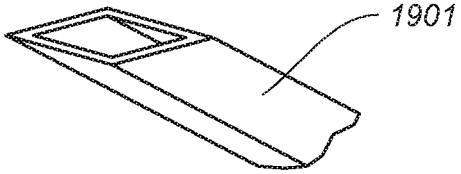
FIGS. 7A-7B are simplified diagrams of cross-sectional views of the one or more support trusses respectively as parts of the gantry crane vehicle for performing one or more tasks in a photovoltaic array according to certain embodiments of the present invention.
Figure 7A:
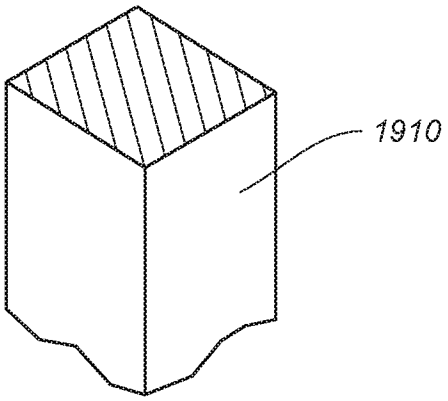

FIGS. 7A-7B are simplified diagrams of cross-sectional views of the one or more support trusses 1910 and 1901 respectively as parts of the gantry crane vehicle 1900 for performing one or more tasks in a photovoltaic array according to certain embodiments of the present invention. These diagrams are merely examples, which should not unduly limit the scope of the claims. One of ordinary skill in the art would recognize many variations, alternatives, and modifications. In one embodiment, the one or more support trusses 1910 each include a square-solid section with a square-shape cross-section. In another embodiment, the one or more support trusses 1901 each include a square-hollow section with a square-shape cross-section.

Figure 8A:
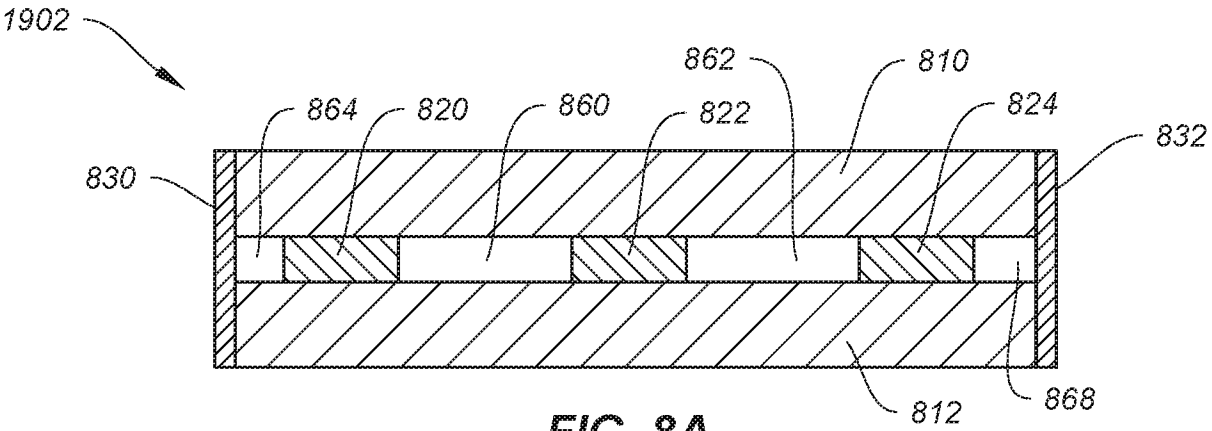
FIGS. 8A-8C are simplified diagrams of top view, side view, and cross-sectional views of the one or more support trusses respectively as parts of the gantry crane vehicle for performing one or more tasks in a photovoltaic array according to certain embodiments of the present invention.
Figure 8B:
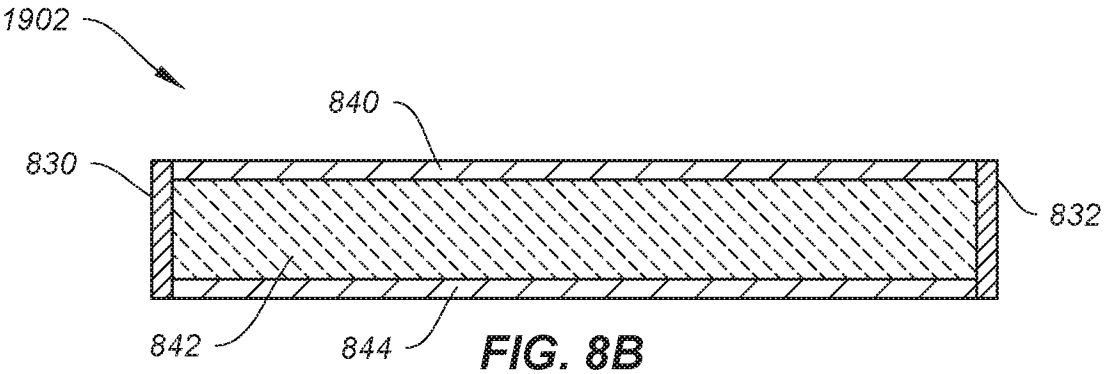
Figure 8C:
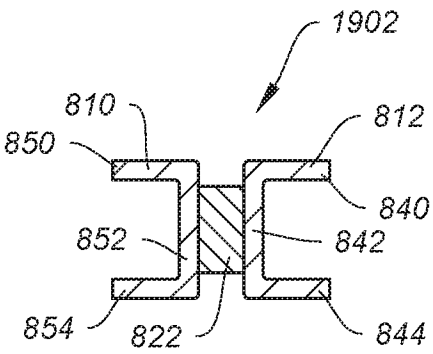

FIGS. 8A-8C are simplified diagrams of top view, side view, and cross-sectional views of the one or more support trusses 1902 respectively as parts of the gantry crane vehicle 1900 for performing one or more tasks in a photovoltaic array according to certain embodiments of the present invention. These diagrams are merely examples, which should not unduly limit the scope of the claims. One of ordinary skill in the art would recognize many variations, alternatives, and modifications.

In one embodiment, the one or more support trusses 1902 each include side segments 810 and 812, middle segments 820, 822 and 824, and end segments 830 and 832. For example, the middle segments 820, 822 and 824 are sandwiched between the side segments 810 and 812, and the middle segments 820, 822 and 824 are separated from each other by corresponding slots 860 and 862. In another embodiment, the end segments 830 and 832 are in contact with the ends of the side segments 810 and 812 respectively. For example, the end segment 830 is separated from the middle segment 820 by a slot 864, and the end segment 832 is separated from the middle segment 824 by a slot 868. In yet another embodiment, the side segment 810 includes extension sections 850 and 854 and a middle section 852 that is connected to the extension sections 850 and 854, and the side segment 812 includes extension sections 840 and 844 and a middle section 842 that is connected to the extension sections 840 and 844. For example, the middle segments 820, 822, and 824 are each in contact with the middle sections 842 and 852.

As discussed above and further emphasized here, FIGS. 8A-8C are merely examples, which should not unduly limit the scope of the claims. One of ordinary skill in the art would recognize many variations, alternatives, and modifications. In one embodiment, the middle segment 820 is removed as shown in FIGS. 9A-9B.

Figure 9A:
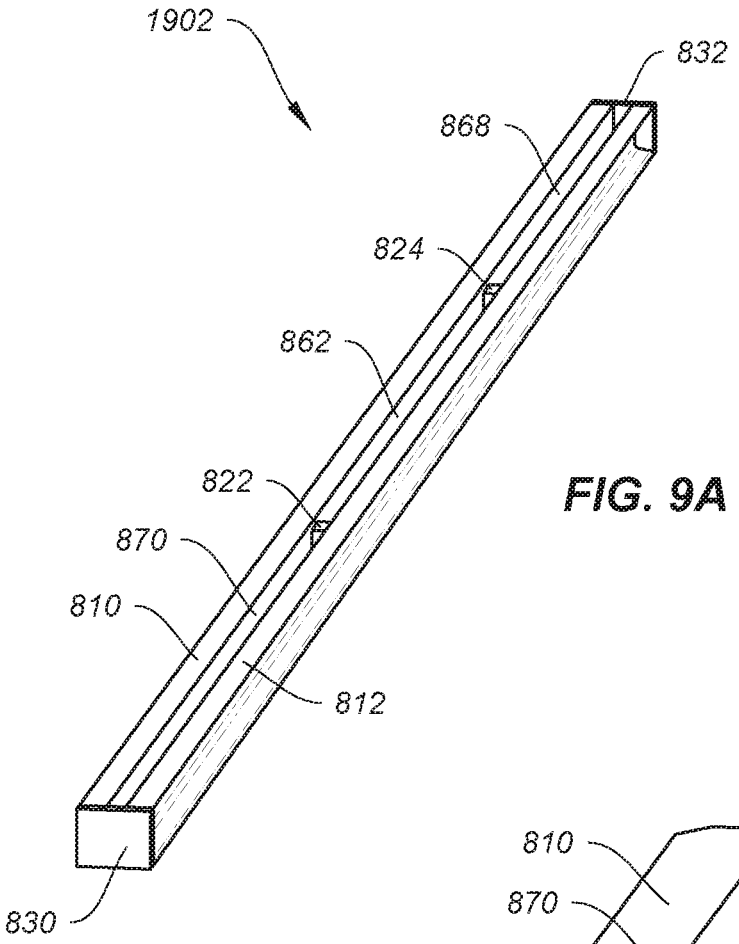
FIGS. 9A-9B are simplified diagrams of the one or more support trusses as parts of the gantry crane vehicle for performing one or more tasks in a photovoltaic array according to some embodiments of the present invention.
Figure 9B:
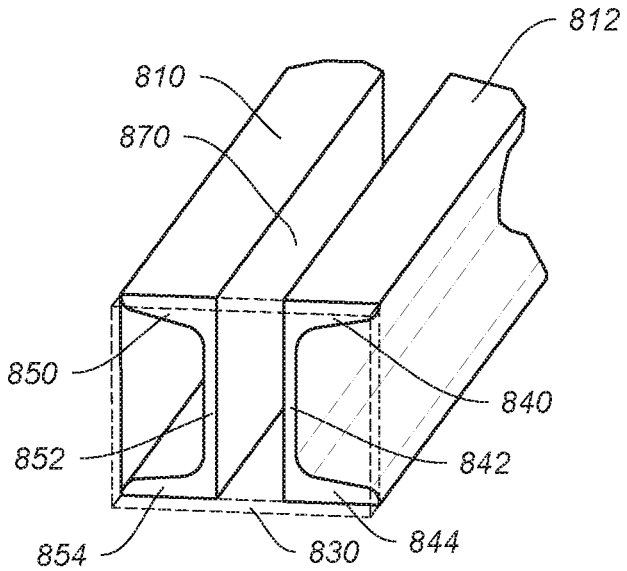

FIGS. 9A-9B are simplified diagrams of the one or more support trusses 1902 as parts of the gantry crane vehicle 1900 for performing one or more tasks in a photovoltaic array according to some embodiments of the present invention. These diagrams are merely examples, which should not unduly limit the scope of the claims. One of ordinary skill in the art would recognize many variations, alternatives, and modifications.

In one embodiment, the one or more support trusses 1902 each include the side segments 810 and 812, the middle segments 822 and 824, and the end segments 830 and 832. For example, the middle segments 822 and 824 are sandwiched between the side segments 810 and 812, and the middle segments 822 and 824 are separated from each other by the slot 862. In another embodiment, the end segments 830 and 832 are in contact with the ends of the side segments 810 and 812 respectively. For example, the end segment 830 is separated from the middle segment 822 by a slot 870, and the end segment 832 is separated from the middle segment 824 by the slot 868. In yet another embodiment, the side segment 810 includes the extension sections 850 and 854 and the middle section 852 that is connected to the extension sections 850 and 854, and the side segment 812 includes the extension sections 840 and 844 and the middle section 842 that is connected to the extension sections 840 and 844. For example, the middle segments 822 and 824 are each in contact with the middle sections 842 and 852.

Figure 10B:
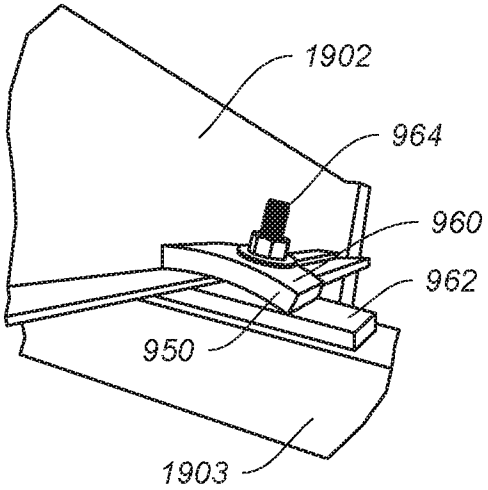
FIGS. 10A-10B are simplified diagrams showing one or more connections between the support trusses and between the support trusses respectively as parts of the gantry crane vehicle for performing one or more tasks in a photovoltaic array according to some embodiments of the present invention.
Figure 10A:
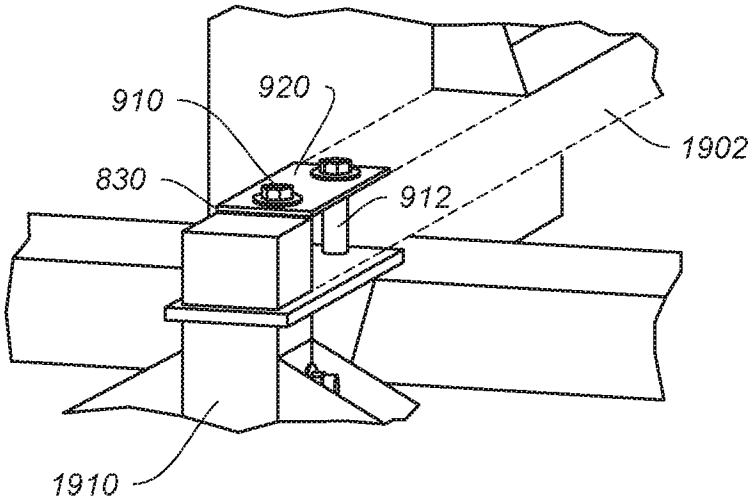

FIGS. 10A-10B are simplified diagrams showing one or more connections between the support trusses 1902 and 1910 and between the support trusses 1902 and 1903 respectively as parts of the gantry crane vehicle 1900 for performing one or more tasks in a photovoltaic array according to some embodiments of the present invention. These diagrams are merely examples, which should not unduly limit the scope of the claims. One of ordinary skill in the art would recognize many variations, alternatives, and modifications.

In one embodiment, the support truss 1902 is fixed to the support truss 1910 using two bolts 910 and 912 and a contact plate 920. For example, the two bolts 910 and 912 extend into a slot of the support truss 1902 (e.g., the slot 864 or the slot 870) through the contact plate 920. In another embodiment, the support truss 1902 is fixed to the support truss 1903 by a clip assembly 950. For example, the clip assembly 950 includes two clip components 960 and 962, and a bolt 964. In another example, the clip component 962 is attached to the support truss 1903, and part of the support truss 1902 is pressed between the client components 960 and 962 by the bolt 964.

According to another embodiment, a gantry crane vehicle for performing one or more tasks in a photovoltaic array includes one or more base plates (e.g., the one or more components 1970), and one or more tracks (e.g., the one or more components 1903) above the one or more base plates. Additionally, the vehicle includes one or more gantry assemblies (e.g., the one or more components 1946) configured to slide along the one or more tracks, and one or more first support trusses (e.g., the one or more components 1901, 1902, 1910, 1912, and/or 1914) configured to support the one or more tracks above the one or more base plates. Moreover, the vehicle includes one or more second support trusses (e.g., the one or more components 1905) connected to at least some of the one or more first support trusses, and one or more storage cabinets (e.g., the one or more components 1950) located on the one or more base plates. The one or more storage cabinets (e.g., the one or more components 1950) include one or more top surfaces (e.g., the one or more components 1952) and one or more side surfaces (e.g., the one or more components 1956), and the one or more top surfaces (e.g., the one or more components 1952) are located below the one or more tracks. The one or more second support trusses (e.g., the one or more components 1905) are attached to the one or more side surfaces through one or more attachment components (e.g., the one or more components 1958). Each of the one or more gantry assemblies (e.g., the one or more components 1946) includes a lift component (e.g., the component 1982) and one or more frame components (e.g., the one or more components 1984 and/or 1986) attached to the lift component. The lift component is configured to move the one or more frame components from a first position above one or more planes corresponding to the one or more base plates to a second position below the one or more planes corresponding the one or more base plates. For example, the gantry crane vehicle is implemented according to at least FIG. 3 and/or FIG. 5. In another example, the lift component includes a scissor lift component. In yet another example, the vehicle is configured to perform one or more tasks including at least one selected from a group consisting of an installation task, an operation task, and a maintenance task.

According to yet another embodiment, a gantry crane vehicle for performing one or more tasks in a photovoltaic array includes one or more base plates (e.g., the one or more components 1970), and one or more tracks (e.g., the one or more components 1903) above the one or more base plates. Additionally, the vehicle includes one or more gantry assemblies (e.g., the one or more components 1946) configured to slide along the one or more tracks, and one or more first support trusses (e.g., the one or more components 1901, 1902, 1910, 1912, and/or 1914) configured to support the one or more tracks above the one or more base plates. Moreover, the vehicle includes one or more second support trusses (e.g., the one or more components 1905) connected to at least some of the one or more first support trusses, and one or more storage cabinets (e.g., the one or more components 1950) located on the one or more base plates. The one or more storage cabinets (e.g., the one or more components 1950) include one or more top surfaces (e.g., the one or more components 1952) and one or more side surfaces (e.g., the one or more components 1956), and the one or more top surfaces (e.g., the one or more components 1952) are located below the one or more tracks. Each of the one or more gantry assemblies (e.g., the one or more components 1946) includes a lift component (e.g., the component 1982) and one or more frame components (e.g., the one or more components 1984 and/or 1986). The one or more frame components (e.g., the one or more components 1984 and/or 1986) are attached to the lift component, and include a first frame component (e.g., the component 1986). The lift component is configured to move the one or more frame components from a first position above one or more planes corresponding to the one or more base plates to a second position below the one or more planes corresponding to the one or more base plates. The first frame component (e.g., the component 1986) is configured to hold an object (e.g., the panel 600) and roll the held object around an axis (e.g., the axis 620). For example, the gantry crane vehicle is implemented according to at least FIG. 3, FIG. 5, FIG. 6A, and/or FIG. 6B. In another example, the first frame component (e.g., the component 1986) is configured to hold a solar panel as the object and roll the held solar panel around the axis. In yet another example, the first frame component (e.g., the component 1986) includes an actuator (e.g., the component 610) configured to cause the first frame component to hold the object and roll the held object around the axis.

According to yet another embodiment, a gantry crane vehicle for performing one or more tasks in a photovoltaic array includes one or more base plates (e.g., the one or more components 1970), and one or more tracks (e.g., the one or more components 1903) above the one or more base plates. Additionally, the vehicle includes one or more gantry assemblies (e.g., the one or more components 1946) configured to slide along the one or more tracks, and one or more first support trusses (e.g., the one or more components 1901, 1902, 1910/410, 1912, and/or 1914) configured to support the one or more tracks above the one or more base plates. Moreover the vehicle includes one or more second support trusses (e.g., the one or more components 1905) connected to at least some of the one or more first support trusses, and one or more storage cabinets (e.g., the one or more components 1950) located on the one or more base plates. The one or more storage cabinets (e.g., the one or more components 1950) include one or more top surfaces (e.g., the one or more components 1952) and one or more side surfaces (e.g., the one or more components 1956). The one or more top surfaces (e.g., the one or more components 1952) are located below the one or more tracks, and are separated from the one or more tracks by one or more distances respectively. The gantry crane vehicle is configured to change the one or more distances from one or more first distance magnitudes to one or more second distance magnitudes respectively, and the one or more second distance magnitudes are smaller than the one or more first distance magnitude respectively. For example, the gantry crane vehicle is implemented according to at least FIG. 3 and/or FIG. 4. In another example, the one or more second distance magnitudes are substantially equal to zero.

According to yet another embodiment, a gantry crane vehicle for performing one or more tasks in a photovoltaic array includes one or more base plates (e.g., the one or more components 1970), and one or more tracks (e.g., the one or more components 1903) above the one or more base plates. Additionally, the vehicle includes one or more gantry assemblies (e.g., the one or more components 1946) configured to slide along the one or more tracks. Moreover, the vehicle includes one or more first support trusses (e.g., the one or more components 1910) attached to the one or more base plates and substantially perpendicular to the one or more base plates, one or more second support trusses (e.g., the one or more components 1901) connected to at least some of the one or more first support trusses, and one or more third support trusses (e.g., the one or more components 1902) each connected to at least some of the one or more first support trusses or at least some of the one or more second support trusses. Also, the vehicle includes one or more storage cabinets (e.g., the one or more components 1950) located on the one or more base plates. The one or more storage cabinets (e.g., the one or more components 1950) include one or more top surfaces (e.g., the one or more components 1952) and one or more side surfaces (e.g., the one or more components 1956), and the one or more top surfaces (e.g., the one or more components 1952) are located below the one or more tracks. Each of the one or more gantry assemblies (e.g., the one or more components 1946) includes a lift component (e.g., the component 1982) and one or more frame components (e.g., the one or more components 1984 and/or 1986) attached to the lift component. The lift component is configured to move the one or more frame components from a first position above one or more planes corresponding to the one or more base plates to a second position below the one or more planes corresponding to the one or more base plates. Each of the one or more third support trusses (e.g., the one or more components 1902) includes a first side component (e.g., the component 810), a second side component (e.g., the component 812), and multiple middle components (e.g., the components 820, 822, and/or 824). Each of the multiple middle components is sandwiched between and in contact with the first side component and the second side component. The multiple middle components are separated from each other by one or more slots (e.g., the one or more slots 860 and/or 862). For example, the gantry crane vehicle is implemented according to at least FIG. 3, FIG. 5, FIG. 8A, FIG. 8B, FIG. 8C, FIG. 9A, and/or FIG. 9B. In another example, each of the one or more first support trusses (e.g., the one or more components 1910) includes a square-solid section associated with a first square-shape cross-section, and each of the one or more second support trusses (e.g., the one or more components 1901) includes a square-hollow section associated with a second square-shape cross-section.

Although specific embodiments of the present invention have been described, it will be understood by those of skill in the art that there are other embodiments that are equivalent to the described embodiments. For example, various embodiments and/or examples of the present invention can be combined. Accordingly, it is to be understood that the invention is not to be limited by the specific illustrated embodiments, but only by the scope of the appended claims.

What is claimed is:

1. A gantry crane vehicle for performing one or more tasks in a photovoltaic array, the vehicle comprising:
- one or more base plates;
- one or more tracks above the one or more base plates;
- one or more gantry assemblies configured to slide along the one or more tracks;
- one or more first support trusses configured to support the one or more tracks above the one or more base plates;
- one or more second support trusses connected to at least two of the one or more first support trusses;
- one or more storage cabinets located on the one or more base plates, the one or more storage cabinets including one or more top surfaces and one or more side surfaces, the one or more top surfaces being located below the one or more tracks; and
- one or more caterpillar treads configured to travel on one or more support surfaces and support the one or more base plates above the one or more support surfaces;

wherein:
- the one or more second support trusses are attached to the one or more side surfaces through one or more attachment components;
- each of the one or more gantry assemblies includes a lift component and one or more frame components: (i) attached to the lift component; and (ii) each having four sides;
- the lift component is configured to move the one or more frame components from a first position above one or more planes corresponding to the one or more base plates to a second position below the one or more planes corresponding to the one or more base plates; and
- the gantry crane vehicle is configured to place solar panels at a rear of the gantry crane vehicle while the gantry crane vehicle travels.

2. The gantry crane vehicle of claim 1, wherein the lift component includes a scissor lift component.

3. The gantry crane vehicle of claim 1, wherein the gantry crane vehicle is configured to perform one or more tasks including at least one selected from a group consisting of an installation task, an operation task, and a maintenance task.

4. The gantry crane vehicle of claim 1, wherein the one or more base plates extend beyond and parallel to a bottom surface of the one or more storage cabinets.

5. A gantry crane vehicle for performing one or more tasks in a photovoltaic array, the vehicle comprising:
- one or more base plates;
- one or more tracks above the one or more base plates;
- one or more gantry assemblies configured to slide along the one or more tracks;
- one or more first support trusses configured to support the one or more tracks above the one or more base plates;
- one or more second support trusses connected to at least two of the one or more first support trusses;
- one or more storage cabinets located on the one or more base plates, the one or more storage cabinets including one or more top surfaces and one or more side surfaces, the one or more top surfaces being located below the one or more tracks; and
- one or more caterpillar treads configured to travel on one or more support surfaces and support the one or more base plates above the one or more support surfaces;

wherein:
- each of the one or more gantry assemblies includes a lift component and one or more frame components, the one or more frame components: (i) being attached to the lift component; (ii) each having four sides; and (iii) including a first frame component;
- the lift component is configured to move the one or more frame components from a first position above one or more planes corresponding to the one or more base plates to a second position below the one or more planes corresponding to the one or more base plates;
- one or more gripping tools having suction cups are attached to the first frame component and configured to hold an object and roll the held object around an axis; and
- the gantry crane vehicle is configured to place solar panels at a rear of the gantry crane vehicle while the gantry crane vehicle travels.

6. The gantry crane vehicle of claim 5, wherein the first frame component is configured to hold a solar panel as the object and roll the held solar panel around the axis.

7. The gantry crane vehicle of claim 5, wherein the first frame component includes an actuator configured to cause the first frame component to hold the object and roll the held object around the axis.

8. The gantry crane vehicle of claim 5, wherein the axis is: (i) coincident with the first frame component; and (ii) constrained in a direction transverse to a traveling of the gantry crane vehicle.

9. The gantry crane vehicle of claim 5, wherein the one or more frame components are separate and distinct from the first frame component.

10. A gantry crane vehicle for performing one or more tasks in a photovoltaic array, the vehicle comprising:
- one or more base plates;
- one or more tracks above the one or more base plates;
- one or more gantry assemblies configured to slide along the one or more tracks;
- one or more first support trusses configured to support the one or more tracks above the one or more base plates;
- one or more second support trusses connected to at least two of the one or more first support trusses;
- one or more storage cabinets located on the one or more base plates, the one or more storage cabinets including one or more top surfaces and one or more side surfaces, the one or more top surfaces being located below the one or more tracks and separated from the one or more tracks by one or more distances respectively; and one or more caterpillar treads configured to travel on one or more support surfaces and support the one or more base plates above the one or more support surfaces;

wherein the one or more first support trusses and the one or more second support trusses are configured to cantilever on a rear side of the gantry crane vehicle, the rear being defined in a direction opposite from a traveling of the gantry crane vehicle.

11. The gantry crane vehicle of claim 10, wherein the one or more first support trusses and the one or more second support trusses are further configured to extend the one or more gantry assemblies beyond one or more sides of the gantry crane vehicle.

12. The gantry crane vehicle of claim 10, wherein the gantry crane vehicle is configured to place solar panels at the rear of the gantry crane vehicle while the gantry crane vehicle travels.

13. A gantry crane vehicle for performing one or more tasks in a photovoltaic array, the vehicle comprising:

one or more base plates;

one or more tracks above the one or more base plates;

one or more gantry assemblies configured to slide along the one or more tracks;

one or more first support trusses attached to the one or more base plates and substantially perpendicular to the one or more base plates;

one or more second support trusses connected to at least two of the one or more first support trusses;

one or more third support trusses each connected to at least two of the one or more first support trusses or at least two of the one or more second support trusses;

one or more storage cabinets located on the one or more base plates, the one or more storage cabinets including one or more top surfaces and one or more side surfaces, the one or more top surfaces being located below the one or more tracks; and one or more caterpillar treads configured to travel on one or more support surfaces and support the one or more base plates above the one or more support surfaces;

wherein:

each of the one or more gantry assemblies includes a lift component and one or more frame components: (i) attached to the lift component; and (ii) having four sides;

the lift component is configured to move the one or more frame components from a first position above one or more planes corresponding to the one or more base plates to a second position below the one or more planes corresponding to the one or more base plates;

each of the one or more third support trusses includes a first side segment, a second side segment, and multiple middle segments;

the first side segment, the second side segment, and the multiple middle segments extend in lengthwise parallel directions, and a first length and a first width of the first and second side segments is greater than a second length and a second width of the middle segments;

each of the multiple middle segments is sandwiched between the first side segment and the second side segment;

the multiple middle segments are separated from each other by one or more slots; and the gantry crane vehicle is configured to place solar panels at a rear of the gantry crane vehicle while the gantry crane vehicle travels.

14. The gantry crane vehicle of claim 13, wherein:

each of the one or more first support trusses includes a square-solid section associated with a first square-shape cross-section; and each of the one or more second support trusses includes a square-hollow section associated with a second square-shape cross-section.

15. The gantry crane vehicle of claim 13, wherein each of the one or more third support trusses further includes first and second end segments that are in contact with opposite ends of each of the first and second side segments.

16. The gantry crane vehicle of claim 15, wherein each of the first and second end segments further includes extension sections that are in contact with the first and second end segments.

* * * * *